US009523482B2

(12) United States Patent
Ye

(10) Patent No.: US 9,523,482 B2
(45) Date of Patent: Dec. 20, 2016

(54) LED LENS ASSEMBLIES, LED MODULES AND LED LIGHT FIXTURES

(71) Applicant: SHANGHAI YUANMING LIGHTING TECHNOLOGY CO., LTD., Shanghai (CN)

(72) Inventor: Jishuang Ye, Shanghai (CN)

(73) Assignee: SHANGHAI YUANMING LIGHTING TECHNOLOGY CO., LTD., Shanghai (CN)

( * ) Notice: Subject to any disclaimer, the term of this patent is extended or adjusted under 35 U.S.C. 154(b) by 58 days.

(21) Appl. No.: 14/735,311

(22) Filed: Jun. 10, 2015

(65) Prior Publication Data

US 2016/0003454 A1 Jan. 7, 2016

(30) Foreign Application Priority Data

| | | |
|---|---|---|
| Jul. 4, 2014 | (CN) | 2014 2 0369847 U |
| Jul. 15, 2014 | (CN) | 2014 2 0389959 U |
| Aug. 12, 2014 | (CN) | 2014 2 0451304 U |
| Feb. 13, 2015 | (CN) | 2015 1 0080272 |

(51) Int. Cl.

| | |
|---|---|
| ***F21V 17/10*** | (2006.01) |
| ***F21V 5/04*** | (2006.01) |
| ***F21V 29/89*** | (2015.01) |
| ***F21V 31/00*** | (2006.01) |
| ***F21V 29/76*** | (2015.01) |
| ***F21V 29/15*** | (2015.01) |
| ***F21V 5/00*** | (2015.01) |

(Continued)

(52) U.S. Cl.

CPC ..... *F21V 17/10* (2013.01); *F21V 5/007* (2013.01); *F21V 5/048* (2013.01); *F21V 29/15* (2015.01); *F21V 29/76* (2015.01); *F21V 29/89* (2015.01); *F21V 31/005* (2013.01); *F21W 2131/103* (2013.01); *F21Y 2101/00* (2013.01)

(58) Field of Classification Search

CPC ..... F21V 17/10; F21V 29/15; F21V 29/76; F21V 29/89; F21V 5/007; F21V 5/048; F21V 31/005; F21W 2131/103; F21Y 101/00

See application file for complete search history.

(56) References Cited

U.S. PATENT DOCUMENTS

| | | | | |
|---|---|---|---|---|
| 6,184,628 | B1 * | 2/2001 | Ruthenberg | H05B 33/0827 315/185 R |
| 2011/0292658 | A1 * | 12/2011 | Ho | F21V 5/007 362/307 |
| 2013/0016511 | A1 * | 1/2013 | Mansfield | F21K 9/00 362/244 |

FOREIGN PATENT DOCUMENTS

| | | |
|---|---|---|
| CN | 201836825 U | 5/2011 |
| CN | 201836842 U | 5/2011 |
| CN | 103256559 A | 8/2013 |

* cited by examiner

*Primary Examiner* — Mary Ellen Bowman
(74) *Attorney, Agent, or Firm* — Rabin & Berdo, P.C.

(57) ABSTRACT

The present invention relates to a LED lens assembly including a lens base, a plurality of lens elements on the lens base, a cable channel on the lens base, a frame at the periphery of the lens base, and clips on the frame. A bottom portion of the frame defines a lip, external to which there is formed a groove for receiving overfill of a sealant. Each of the clips has a trailing portion extending to an edge of the frame. The invention further provides a LED module and a LED light fixture, both incorporating the LED lens assembly. Use of this structure can lead to the following beneficial effects: convenience in mounting; better waterproofing results; and applicability in light used in an obliquely upward orientation, such as flood lights.

14 Claims, 8 Drawing Sheets

(51) Int. Cl.

| | |
|---|---|
| *F21W 131/103* | (2006.01) |
| *F21Y 101/00* | (2016.01) |

LED LENS ASSEMBLIES, LED MODULES AND LED LIGHT FIXTURES

TECHNICAL FIELD

The present invention relates to the field of lighting and, more particularly, to LED lens assemblies, and LED modules and LED fixtures incorporating the LED lens assemblies.

BACKGROUND

In the current context of concerns about global energy shortage rising once again, energy conservation and use of new energy have become a theme that the society should pay common attention to. In the field of lighting, the application of LED lighting products is attracting the world's attention. As new "green" lighting products, LEDs will surely be the future trend of lighting, and the twenty-first century will be an era of new lighting sources with LEDs as the mainstream.

Most conventional LED lenses commonly available in the market are designed to be fixed on a heat dissipation means by means of screws. This design is not convenient for mounting and maintenance. There are also a small number of LED lenses using clips, examples of which include those described in Chinese Patent Nos. CN201836825U, CN201836842U and CN103256559A. Each of these lenses is configured to be deployed over a circuit board that is fixed on a heat dissipation means, and essentially includes: a lens base; lens elements arranged on the lens base; channels for housing screws and cables; seal ring grooves; and clips that are arranged at a periphery of the lens base and adapted to connect the heat dissipation means.

Conventional LED modules commonly resort to a resilient sealing ring or sealant-filled surface groove for their waterproofness and incorporate a thermally conductive bottom plate made of an aluminum alloy material. Such design suffers from insufficient water-proofing and heat-dissipating abilities and inconvenience in mounting and maintenance.

SUMMARY

It is therefore the object of the present invention to provide LED lens assemblies, and LED modules and LED fixtures incorporating the LED lens assemblies, which overcome the inconvenient mounting, unsatisfactory waterproofing and inadequate sealing problems arising from the use of conventional LED lens products.

In pursuit of this object, according to an aspect of the present invention:

a LED lens assembly includes a lens base, a plurality of lens elements on the lens base, a cable channel on the lens base, a frame at the periphery of the lens base, and clips on the frame. A bottom portion of the frame defines a lip, next to which a groove for receiving overfill of a sealant is formed. Each of the clips has a trailing portion extending to an edge of the frame.

Additionally, the cable channel may have a height that is greater than 1 mm, with 1-2 mm being more preferred.

Further, alternatively, two grooves for receiving overfill of the sealant may be formed on opposing sides of the lip.

Further, the number of the clip may be 3-20.

Further, the lens base may assume a triangular, rectangular, pentagonal, hexagonal, heptagonal, octagonal, round or elliptical shape.

Further, an arrow may be marked on the lens base in order to indicate a direction of the LED lens assembly.

According to another aspect of the invention, a LED module includes the LED lens assembly as defined above.

In addition, the LED module may include, from the bottom upward, a heat-conducting bottom plate, a heat-conducting aluminum base plate attached thereon with a plurality of LEDs, and the LED lens assembly.

The heat-conducting bottom plate has a mounting surface defining a cable outlet hole, and the heat-conducting aluminum base plate defines another cable outlet hole. A recess for receiving a resilient sealing ring is provided between the cable outlet hole in the heat-conducting aluminum base plate and the cable outlet hole in the heat-conducting bottom plate. A cable extends successively through the cable outlet hole in the heat-conducting bottom plate, the resilient sealing ring and the cable outlet hole in the heat-conducting aluminum base plate and has a portion received in the cable channel of the LED lens assembly and welded therein to the heat-conducting aluminum base plate. The resilient sealing ring is fixed within the recess by an adhesive filled therein such that a waterproof seal is formed.

At least one sealing groove is formed in the heat-conducting bottom plate, alongside its periphery. A waterproof seal is formed by filling a sealant in the sealing groove and further inserting the lip on the bottom portion of the frame, during which any overfill of the sealant is received within the groove external to the lip.

A heat-conducting silicon resin is applied between the heat-conducting aluminum base plate and the heat-conducting bottom plate.

The heat-conducting aluminum base plate is fastened on the heat-conducting bottom plate either by screws or by a piece of double-sided adhesive tape that is thermally conductive.

The LED lens assembly is also fastened on the heat-conducting bottom plate through the clips after the filling of the sealant.

The heat-conducting bottom plate is provided with securing mechanisms distributed along its periphery or two opposing edges.

The heat-conducting bottom plate defines at least one cable outlet groove.

Further, at least one LED lamp may be further provided on the heat-conducting aluminum base plate.

Further, the heat-conducting bottom plate may have protruding portions matching the respective clips.

Further, the heat-conducting bottom plate may be fabricated from a material with a thermal conductivity of higher than 90 W/m·K, selected from silicon carbide, copper, aluminum, aluminum alloys, graphite and ceramics.

Further, the heat-conducting bottom plate may have a height of 3-30 mm.

According to yet another aspect of the invention, a modular LED light fixture includes a fixture body, waterproof plugs or sealing rings, and a LED-module cable. The fixture body is provided thereon with a mounting surface, an electrical component box and cooling fins. One or more LED modules as defined above are mounted on the mounting surface.

In addition, in order for waterproof sealing, the LED-module cable may extend through at least one of the waterproof plugs or sealing rings and a cable inlet bore, into the electrical component box.

Further, the cable inlet bore may be tilted at an angle of 0-180°, more preferably, 5-175°, with respect to the mounting surface.

The present invention provides the following benefits:

(1) It allows more convenient and reliable mounting.

(2) Improved waterproofness is resulted from the reception of overfill of a liquid silica gel in groove(s) formed next to the sealing groove.

(3) Each of the clips has a strength-improved trailing portion and hence obtains improved ruggedness.

(4) The frame 0.2-5 mm higher than the highest internal portion results in improved ruggedness and less deformability of the lens base and makes it possible to block a large amount of rainwater from flowing onto the lens base, which can affect the light distribution or emission performance.

(5) LED light fixtures according to the present invention use LED modules not equipped with heat dissipation means and rely instead on the heat dissipation means on their fixture bodies for heat dissipation. This leads to the advantages of convenience in mounting and maintenance, high versatility, low replacement cost, and modifiability for use in various light fixtures with heat dissipation means.

(6) LED light fixtures according to the present invention have good waterproof performance ensured by multiple waterproof features including: one or more waterproof plugs or sealing rings and a cable inlet bore in the fixture body arranged in the path of each cable extending into an electrical component box, an waterproof adhesive filled in gaps between lenses and between lenses and the heat-conducting bottom plate, of each LED module; and sealant-sealed resilient sealing rings.

DETAILED DESCRIPTION

LED lens assemblies, and LED modules and LED fixtures incorporating the LED lens assemblies according to the present invention are described in greater detail below with reference to several exemplary embodiments, taken in conjunction with the accompanying drawings. It is to be understood that the embodiments set forth below are for the purpose of illustrating the invention rather than limiting its scope.

Embodiment 1

LED Lens Assembly

Figure 1:
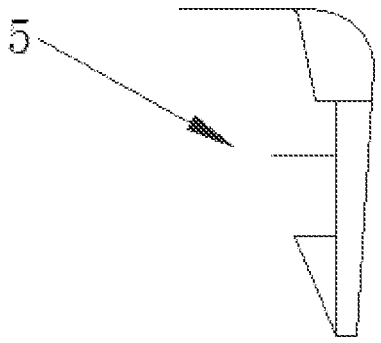
FIG. 1 is a schematic illustration of a clip in a LED lens assembly constructed in accordance with Embodiment 1 of the present invention.
Figure 2:
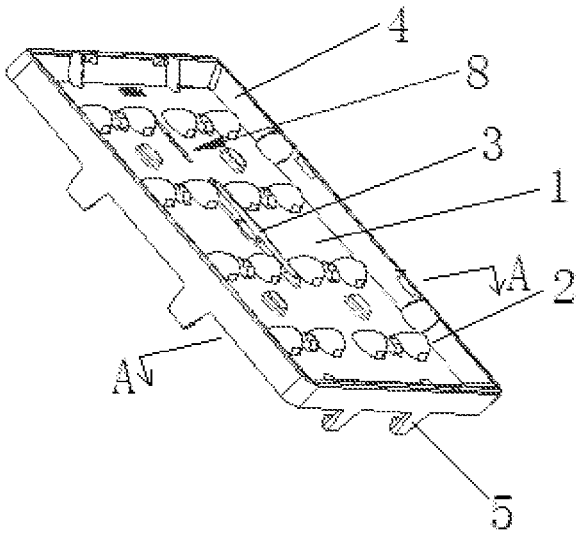
FIG. 2 is a schematic, three-dimensional view of the LED lens assembly constructed in accordance with Embodiment 1 of the present invention.
Figure 3:
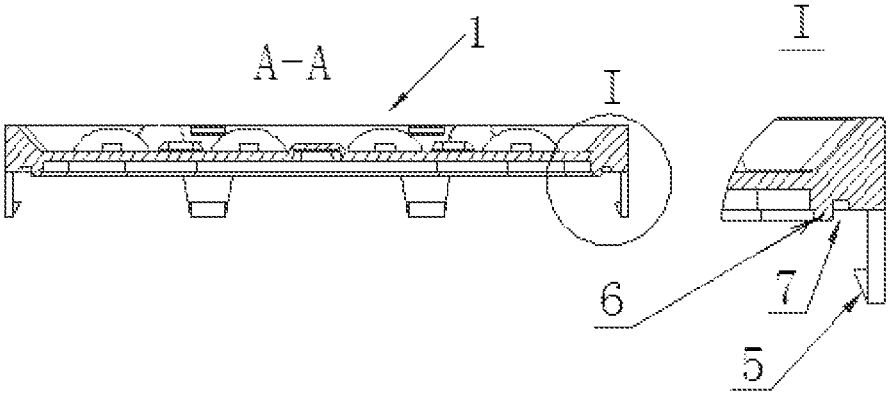
FIG. 3 shows a cutaway view taken along line A-A of FIG. 2 and an enlarged view of the portion I, of the LED lens assembly constructed in accordance with Embodiment 1 of the present invention.

As shown in FIGS. 1 to 3, a LED lens assembly according to this embodiment 1 includes a lens base 1; a plurality of lens elements 2 and a cable channel 3, on lens base 1; a frame 4 at the periphery of lens base 1; and clips 5 on the frame 4. In a bottom surface of frame 4, a groove 7 for receiving overfill of a sealant is defined external to (on the right as shown in the figures in connection with the description of this embodiment) a lip 6 projecting from the bottom surface. Lip 6 can prevent an insufficient sealing effect caused by overfill of the sealant. Frame 4 is 0.2-5 mm higher than the highest internal portion, thus resulting in improved ruggedness and less deformability of lens base 1 and making it possible to block a large amount of rainwater from flowing onto lens base 1 to affect the light distribution or emission. In this embodiment, lens base 1 is a square, and the cable channel is designed to have a height of 1-2 cm. This can result in improved ruggedness and less deformability of lens base 1, thereby preventing changes in light distribution curves and failure of waterproofness that may be caused by deformation of lens base 1. The number of clips 5 arranged at the periphery of lens base 1 is 3-30, and each of clips 5 has a trailing portion extending to an edge of frame 4 and thus has improved ruggedness. Further, the lens base is provided an arrow 8 marked thereon for indicating a direction of the LED lens assembly.

Embodiment 2

LED Module Incorporating LED Lens Assembly

Figure 4:
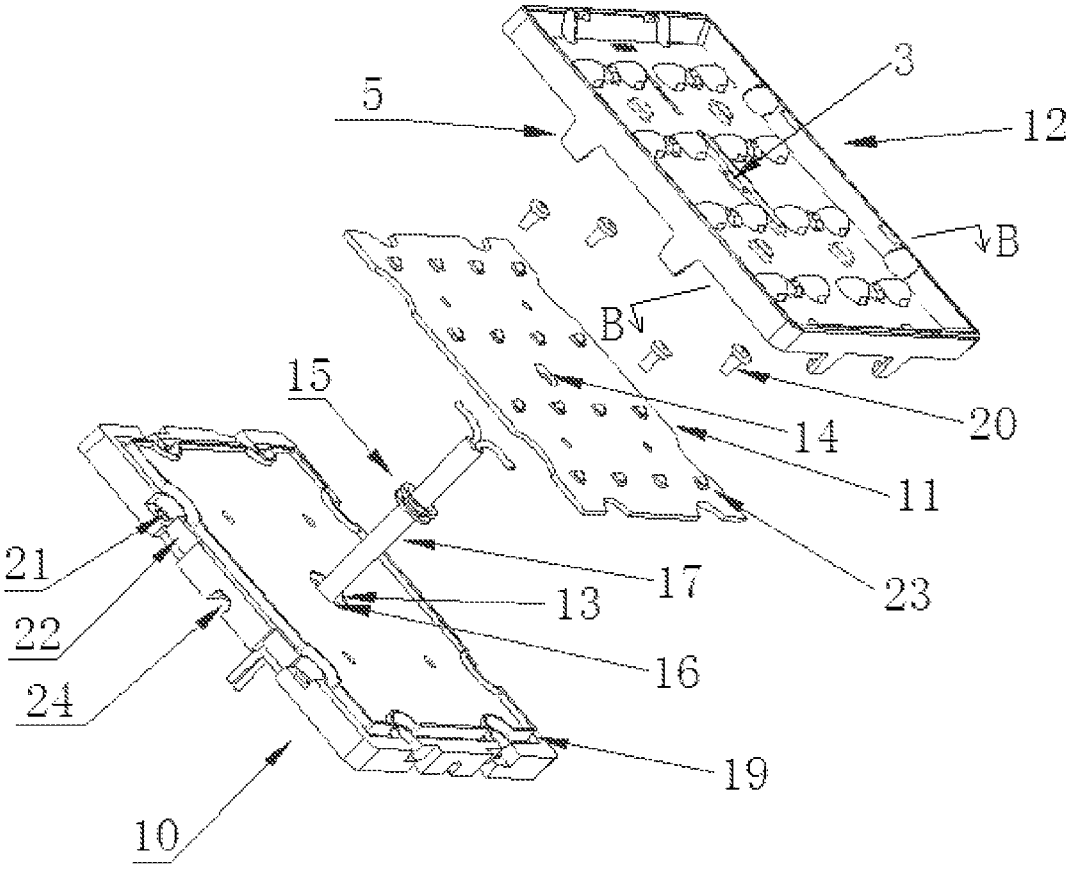
FIG. 4 is a schematic, three-dimensional view of a LED module incorporating a LED lens assembly, constructed in accordance with Embodiment 2 of the present invention.
Figure 5:
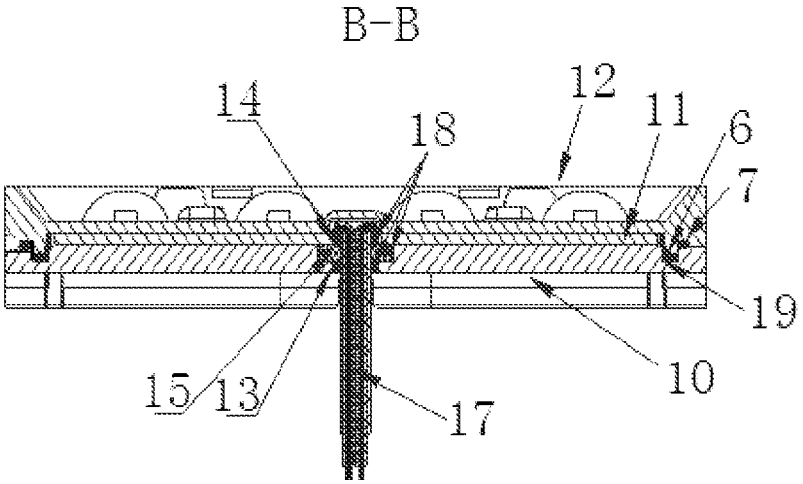
FIG. 5 is a cutaway view of the LED module incorporating the LED lens assembly constructed in accordance with Embodiment 2 of the present invention, taken along line B-B of FIG. 4.
Figure 6:
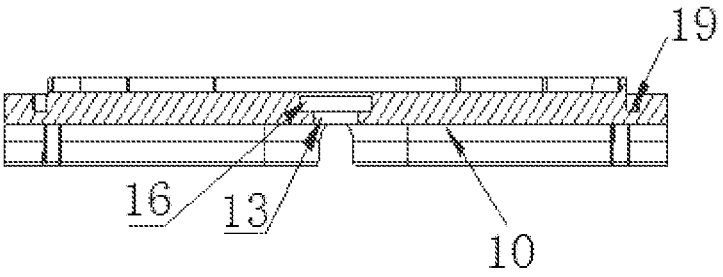
FIG. 6 is another cutaway view of the LED module constructed in accordance with Embodiment 2 of the present invention, taken along line B-B of FIG. 4, in which the LED lens assembly is not shown.

FIGS. 4 to 6 show a LED module incorporating a LED lens assembly constructed in accordance with Embodiment 1. The LED module includes, from the bottom upward, a heat-conducting bottom plate 10, a heat-conducting aluminum base plate 11 attached with a plurality of LEDs, and the LED lens assembly indicated at 12. Cable outlet holes 13 and 14 are formed respectively in a mounting surface of heat-conducting bottom plate 10 and in heat-conducting aluminum base plate 11. A recess 16 for receiving a resilient sealing ring 15 is provided between cable outlet hole 14 in heat-conducting aluminum base plate 11 and cable outlet hole 13 in heat-conducting bottom plate 10. A cable 17 extends successively through cable outlet hole 13, resilient sealing ring 15 and cable outlet hole 14, and has a portion received in cable channel 3 of LED lens assembly 12 and welded therein to heat-conducting aluminum base plate 11. Resilient sealing ring 15 is fixed within recess 16 after an adhesive is filled therein, thus forming a waterproof seal. A sealing groove 19 is defined in the heat-conducting bottom plate 10 alongside its periphery. With a sealant filled in sealing groove 19, a waterproof seal is formed by inserting lip 6 projecting from the bottom surface of frame 4 of LED lens assembly 12 in sealing groove 19. During this process, any overfill of the sealant will be received within groove 7 that is external to lip 6. A heat-conducting silicon resin is applied between heat-conducting aluminum base plate 11 and heat-conducting bottom plate 10. Heat-conducting aluminum base plate 11 is fastened on heat-conducting bottom plate 10 either by screws 20 or by a piece of double-sided adhesive tape that is thermally conductive. LED lens assembly 12 is further fastened on heat-conducting bottom plate 10 by means of clips 5 after the filling of the sealant, in such a manner that, after the fastening, the clips reach a level not higher than the mounting surface of heat-conducting bottom plate 10. Heat-conducting bottom plate 10 is provided with mounting holes 21 distributed along its periphery or two opposing edges, and has protruding portions 22 matching the respective clips. 10-50 LED lamps 23 are disposed on heat-conducting aluminum base plate 11. In addition, in a backside of heat-conducting bottom plate 10, there is formed a cable outlet groove 24 leading from cable outlet hole 13. Heat-conducting bottom plate 10 is fabricated from a material with a thermal conductivity higher than 90 W/m·K, selected from silicon carbide, copper, aluminum, aluminum alloys, graphite and ceramics.

Embodiment 3

Modular LED Light Fixture

Figure 7:
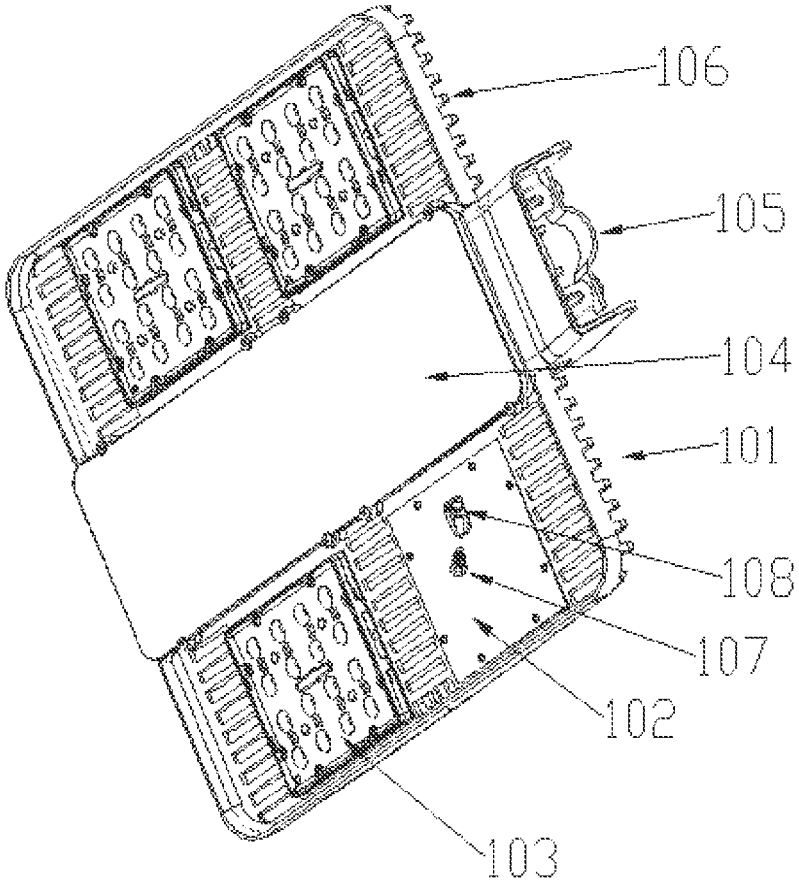
FIG. 7 is a schematic showing a structure in accordance with Embodiment 3 of the present invention.

FIG. 7 shows a LED light fixture using LED modules constructed in accordance with Embodiment 2. The fixture includes a fixture body 101, on which there are arranged 4 mounting surfaces 102, an electrical component box 104, a band clamp 105 for securing a mounting bracket and cooling fins 106. Electrical component box 104 is disposed between adjacent ones of mounting surfaces 102. Band clamp 105 and cooling fins 106 are arranged on the periphery of fixture body 101. Each of mounting surfaces 102 is provided with a LED module 103, a waterproof plug 107 and a cable inlet bore 108 tilted at an angle of 5-175° (−5-175°). Cables for LED module 103 are coupled to a power supply and extend into electrical component box 104 via respective waterproof plugs 107 and cable inlet bores 108. Preferably, each of LED modules 103 is fastened to one of mounting surfaces 102 by means of 8 screws. In this embodiment, LED modules 103 are not provided with any heat dissipation means and heat generated by them after they are mounted on the light fixture is dissipated via the cooling means on fixture body 101.

Embodiment 4

Modular LED Light Fixture

Figure 8:
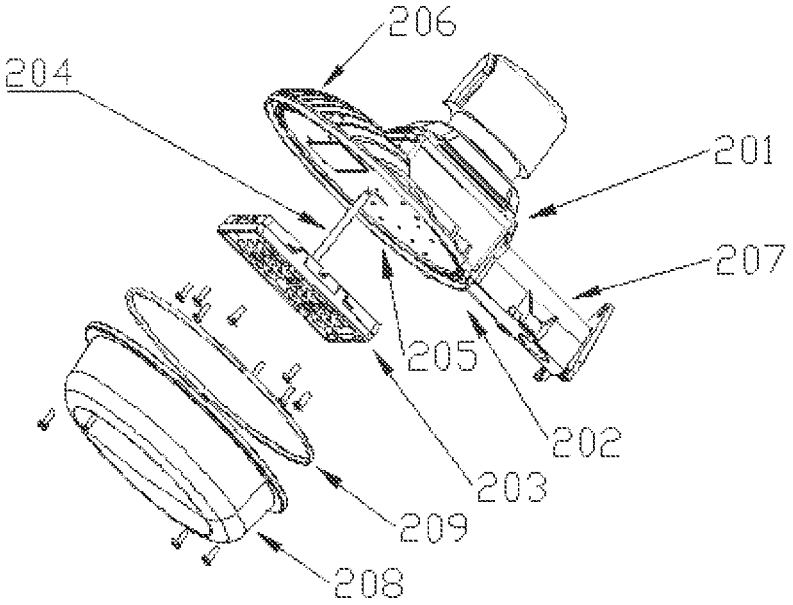
FIG. 8 is a schematic showing a structure in accordance with Embodiment 4 of the present invention.

FIG. 8 shows a modular LED light fixture in another form, including a fixture body 201 and a cover 208. On fixture body 201, there are provided a mounting surface 202, an electrical component box (not shown), cooling fins 206 and a mounting bracket 207. Mounting surface 202 and the electrical component box are disposed in a lower portion of fixture body 201. Cooling fins 206 are arranged on a surface of fixture body 201. Mounting bracket 207 is attached to a side face of fixture body 201. Mounting surface 202 defines a cable inlet bore 205 and bears a LED module 203. A cable 204 for LED modules 203 is connected to a power supply and extends into the electrical component box via cable inlet bore 205. Preferably, LED module 203 is fastened to mounting surface 202 by means of 8 screws. Cover 208 is mounted on fixture body 201 by 4 screws, and a sealing ring 209 is disposed between cover 208 and fixture body 201 for imparting waterproofness to the light fixture. In this embodiment, LED module 203 is not provided with any heat dissipation means and heat generated from it after it is mounted on the light fixture is dissipated via the cooling means on fixture body 201.

Embodiment 5

Modular LED Light Fixture

Figure 9:
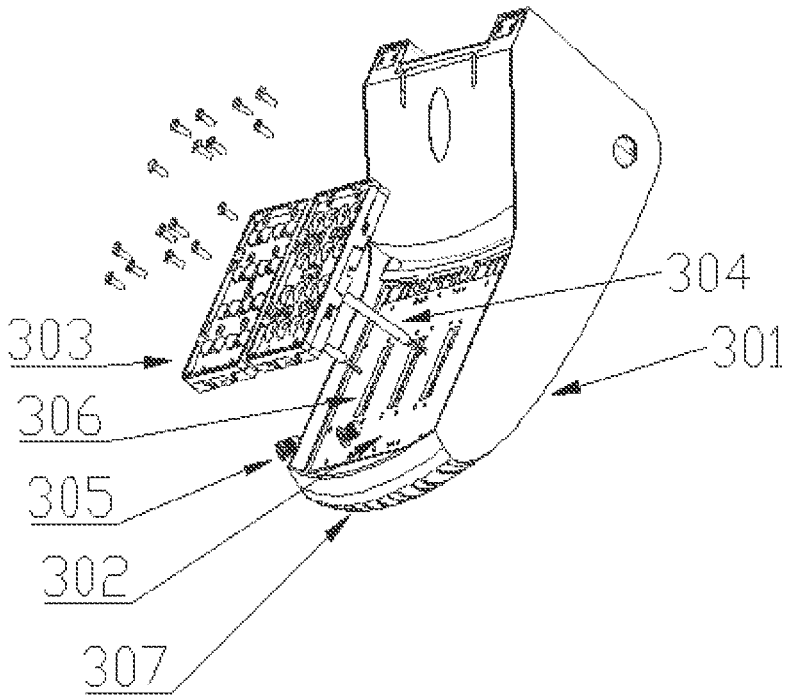
FIG. 9 is a schematic showing a structure in accordance with Embodiment 5 of the present invention.

FIG. 9 shows a modular LED light fixture in yet another form, including a fixture body 301. On fixture body 301, there are provided a mounting surface 302, an electrical component box (not shown) and cooling fins 307. Cooling fins 307 are arranged on a bottom side of fixture body 301. Mounting surface 302 bears two LED modules 303 mounted thereon and defines waterproof plugs 305 and cable inlet bores 306 each tilted at an angle of 5-175° (−5-175°). Cables 304 for LED modules 303 are coupled to a power supply and extend into the electrical component box via respective waterproof plugs 305 and cable inlet bores 306. Preferably, each of LED modules 303 is fastened to mounting surface 302 by means of 8 screws. In this embodiment, LED modules 303 are not provided with any heat dissipation means and heat generated by them after they are mounted on the light fixture is dissipated via the cooling means on the fixture body 301.

Embodiment 6

Modular LED Light Fixture

Figure 10:
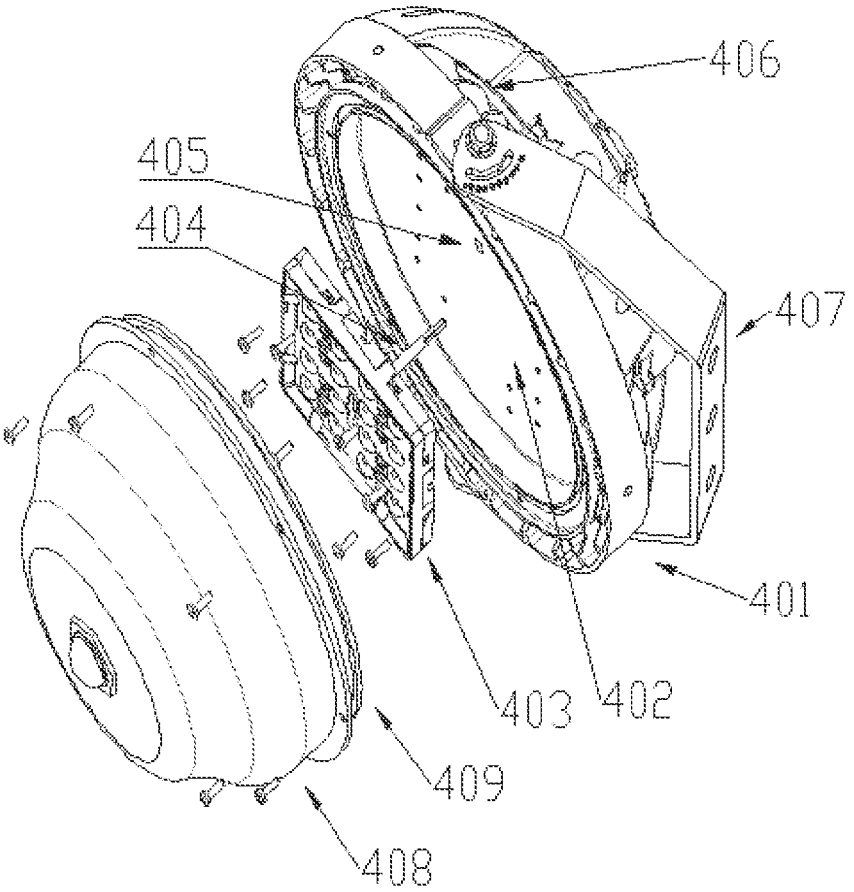
FIG. 10 is a schematic showing a structure in accordance with Embodiment 6 of the present invention.

FIG. 10 shows a modular LED light fixture in still another form, including a fixture body 401 and a cover 408. On fixture body 401, there are provided a mounting surface 402, an electrical component box (not shown), a mounting bracket 407 and cooling fins 406. Cooling fins 406 and mounting bracket 407 are arranged on the periphery of fixture body 401. Mounting surface 402 and the electrical component box are disposed in a lower portion of fixture body 401. A LED module 403 is mounted on mounting surface 202 that defines a cable inlet bore 405. A cable 404 for the LED modules 403 is coupled to a power supply and extends into the electrical component box via cable inlet bore 405. Preferably, LED module 403 is fastened to mounting surface 402 by means of 8 screws. Cover 408 is mounted on fixture body 401 by 6 screws, and a sealing ring 409 is disposed between cover 408 and fixture body 401 for imparting waterproofness to the light fixture. In this embodiment, LED module 403 is not provided with any heat dissipation means and heat generated from it after it is mounted on the light fixture is dissipated via the cooling means on fixture body 401.

Embodiment 7

Modular LED Light Fixture

Figure 11:
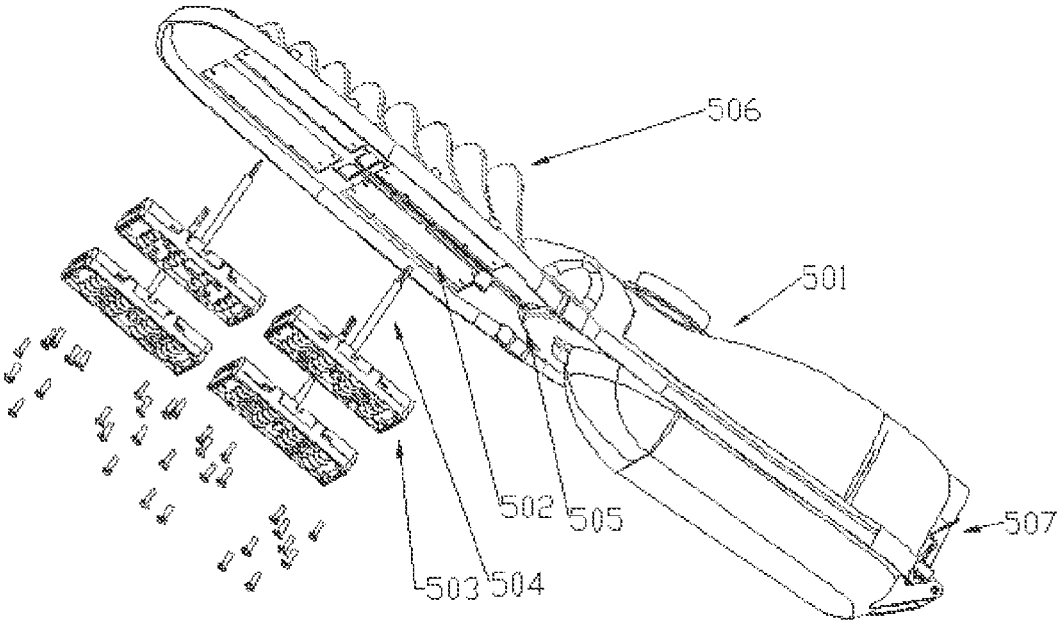
FIG. 11 is a schematic showing a structure in accordance with Embodiment 7 of the present invention.

FIG. 11 shows a modular LED light fixture in yet still another form, including a fixture body 501. On fixture body 501, there are provided 4 mounting surfaces 502, an electrical component box (not shown), a band clamp 507 for securing a mounting bracket and cooling fins 506. Mounting surfaces 102 individually bear 4 LED modules 503 mounted thereon and individually define 4 cable inlet bores 505. Cables 504 for LED modules 503 are coupled to a power supply and extend into the electrical component box via respective cable inlet bores 505. Preferably, LED modules 503 are fastened to respective mounting surfaces 502 by screws. In this embodiment, LED modules 503 are not provided with any heat dissipation means and heat generated by them after they are mounted on the light fixture is dissipated via the cooling means on fixture body 501.

The invention claimed is:

1. A LED lens assembly, comprising a lens base, a plurality of lens elements on the lens base, a cable channel on the lens base, a frame at the periphery of the lens base, and clips on the frame, wherein a bottom portion of the frame defines a lip, next to which a groove for receiving overfill of a sealant is formed, and wherein each of the clips has a trailing portion extending to an edge of the frame.

2. The LED lens assembly of claim 1, wherein the cable channel has a height that is greater than 1 mm.

3. The LED lens assembly of claim 1, wherein the number of the clip is 3-20.

4. The LED lens assembly of claim 1, wherein the lens base assumes a triangular, rectangular, pentagonal, hexagonal, heptagonal, octagonal, round or elliptical shape.

5. The LED lens assembly of claim 1, wherein an arrow is marked on the lens base in order to indicate a direction of the LED lens assembly.

6. A LED module comprising the LED lens assembly as defined in claim 1.

7. The LED module of claim 6, comprising, from the bottom upward, a heat-conducting bottom plate, a heat-conducting aluminum base plate bearing a plurality of LEDs attached thereon, and the LED lens assembly, wherein the heat-conducting bottom plate has a mounting surface defining a cable outlet hole and the heat-conducting aluminum base plate defines another cable outlet hole; a recess for receiving a resilient sealing ring is provided between the cable outlet hole in the heat-conducting aluminum base plate and the cable outlet hole in the heat-conducting bottom plate; a cable extends successively through the cable outlet hole in the heat-conducting bottom plate, the resilient sealing ring and the cable outlet hole in the heat-conducting aluminum base plate and has a portion received in the cable channel of the LED lens assembly and welded therein to the heat-conducting aluminum base plate; and the resilient sealing ring is fixed within the recess by an adhesive filled therein such that a waterproof seal is formed, wherein at least one sealing groove is formed in the heat-conducting bottom plate, alongside its periphery; and a waterproof seal is formed by filling a sealant in the sealing groove and further inserting the lip on the bottom portion of the frame, during which any overfill of the sealant is received within the groove external to the lip, wherein a heat-conducting silicon resin is applied between the heat-conducting aluminum base plate and the heat-conducting bottom plate, wherein the heat-conducting aluminum base plate is fastened on the heat-conducting bottom plate either by screws or by a piece of double-sided adhesive tape that is thermally conductive, wherein the LED lens assembly is also fastened on the heat-conducting bottom plate through the clips after the filling of the sealant, wherein the heat-conducting bottom plate is provided with securing mechanisms distributed along its periphery or two opposing edges, and wherein the heat-conducting bottom plate defines at least one cable outlet groove.

8. The LED module of claim 7, wherein at least one LED lamp is further provided on the heat-conducting aluminum base plate.

9. The LED module of claim 7, wherein the heat-conducting bottom plate has protruding portions matching the respective clips.

10. The LED module of claim 7, wherein the heat-conducting bottom plate is fabricated from a material with a thermal conductivity of higher than 90 W/m·K, selected from silicon carbide, copper, aluminum, aluminum alloys, graphite and ceramics.

11. The LED module of claim 7, wherein the heat-conducting bottom plate has a height of 3-30 mm.

12. A modular LED light fixture, comprising a fixture body, waterproof plugs or sealing rings, and a LED-module cable, wherein the fixture body is provided thereon with a mounting surface, an electrical component box and cooling fins, and wherein one or more LED modules as defined in claim 6 and a cable inlet hole are mounted on the mounting surface.

13. The modular LED light fixture of claim 12, wherein in order for waterproof sealing, the LED-module cable extends through at least one of the waterproof plugs or sealing rings and the cable inlet hole, into the electrical component box.

14. The modular LED light fixture of claim 12, wherein the cable inlet bore is tilted at an angle of 0-180° with respect to the mounting surface.

* * * * *